US010558153B2

(12) United States Patent
Wakatsu et al.

(10) Patent No.: US 10,558,153 B2
(45) Date of Patent: Feb. 11, 2020

(54) FIXING DEVICE THAT CONTROLS ELECTRICAL POWER SUPPLIED TO A FILM BASED ON A DIFFERENCE BETWEEN DETECTION TEMPERATURE VALUES OUTPUT BY A FIRST TEMPERATURE DETECTING MEMBER AND A SECOND TEMPERATURE DETECTING MEMBER

(71) Applicant: CANON KABUSHIKI KAISHA, Tokyo (JP)

(72) Inventors: Kohei Wakatsu, Kawasaki (JP); Takashi Narahara, Mishima (JP); Takeshi Shinji, Yokohama (JP); Toru Imaizumi, Kawasaki (JP); Kazuhiro Doda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/699,086

(22) Filed: Sep. 8, 2017

(65) Prior Publication Data

US 2018/0074444 A1 Mar. 15, 2018

(30) Foreign Application Priority Data

Sep. 13, 2016 (JP) ..... 2016-178417

(51) Int. Cl.
*G03G 15/20* (2006.01)

(52) U.S. Cl.
CPC ..... *G03G 15/2039* (2013.01); *G03G 15/2053* (2013.01); *G03G 15/2028* (2013.01)

(58) Field of Classification Search
CPC ..... G03G 15/2053; G03G 2215/2035; G03G 15/2039
See application file for complete search history.

(56) References Cited

U.S. PATENT DOCUMENTS

| | | | |
|---|---|---|---|
| 8,331,819 | B2 | 12/2012 | Fukuzawa et al. |
| 8,744,296 | B2 | 6/2014 | Fukuzawa et al. |
| 9,417,576 | B2 | 8/2016 | Minamishima et al. |
| 9,436,139 | B2 * | 9/2016 | Kadowaki ..... G03G 15/2039 |

(Continued)

FOREIGN PATENT DOCUMENTS

| | | | |
|---|---|---|---|
| JP | 2004-021079 | A | 1/2004 |
| JP | 2007-272223 | A | 10/2007 |
| JP | 2011-248098 | A | 12/2011 |

*Primary Examiner* — Walter L Lindsay, Jr.
*Assistant Examiner* — Arlene Heredia
(74) *Attorney, Agent, or Firm* — Venable LLP

(57) ABSTRACT

A fixing device includes a cylindrical film including a heat generating layer, a first temperature detecting member contacting the film, and a second temperature detecting member contacting the film and provided at such a position that a temperature change at the position, at which the second temperature detecting member is provided, is slower in responsiveness than at a position at which the first temperature detecting member is provided. A controller stops supply of electrical power to the film depending on a difference between a detection temperature value output by the first temperature detecting member, and a detection temperature value output by the second temperature detecting member. In addition, a toner image, formed on a recording material, is heated by heat from the film and is fixed on the recording material.

4 Claims, 9 Drawing Sheets

(56) References Cited

U.S. PATENT DOCUMENTS

| | | | | |
|---|---|---|---|---|
| 2009/0175645 | A1* | 7/2009 | Seol | G03G 15/2039 399/69 |
| 2010/0086324 | A1* | 4/2010 | Smith | G03G 15/2053 399/67 |
| 2011/0222929 | A1* | 9/2011 | Fujimoto | G03G 15/2042 399/329 |
| 2013/0164055 | A1* | 6/2013 | Tokuhiro | G03G 15/2039 399/329 |
| 2013/0243463 | A1* | 9/2013 | Kanai | G03G 15/2039 399/67 |
| 2015/0227091 | A1 | 8/2015 | Ando et al. | |
| 2016/0282774 | A1* | 9/2016 | Uehara | G03G 15/2053 |
| 2017/0060052 | A1* | 3/2017 | Narahara | G03G 15/2053 |
| 2017/0185016 | A1* | 6/2017 | Kadowaki | G03G 15/2039 |
| 2017/0192378 | A1* | 7/2017 | Hashiguchi | G03G 15/2039 |

* cited by examiner

FIXING DEVICE THAT CONTROLS ELECTRICAL POWER SUPPLIED TO A FILM BASED ON A DIFFERENCE BETWEEN DETECTION TEMPERATURE VALUES OUTPUT BY A FIRST TEMPERATURE DETECTING MEMBER AND A SECOND TEMPERATURE DETECTING MEMBER

This application claims the benefit of Japanese Patent Application No. 2016-178417, filed on Sep. 13, 2016, which is hereby incorporated by reference herein in its entirety.

FIELD OF THE INVENTION AND RELATED ART

The present invention relates to a fixing device and is suitable for an image forming apparatus, such as a copying machine or a printer, employing an electrophotographic type process.

As a fixing device (fixing apparatus) mounted in the image forming apparatus, such as the copying machine or a laser printer, a fixing device of a type in which a heat generating layer is provided on an endless (cylindrical) film and the film itself is caused to generate heat by energizing the heat generating layer (hereafter, this fixing device is referred to as a surface heat generation fixing device) is disclosed (Japanese Laid-Open Patent Application 2007-272223). The surface heat generation fixing device is excellent in that a time from main switch actuation until a state of the fixing device reaches a fixing-enable state is short and that a rising speed is high.

When electrical power is supplied to the fixing device, however, in a state in which, during rotation of the film, the film stops due to a slip, a temperature increase (rise) speed becomes extraordinarily faster than that when the film normally rotates in some cases. This is because, in the state in which the rotation of the film stops, heat is not taken by a pressing roller at a portion, of the film, other than a nip-forming portion and, therefore, the temperature readily increases.

SUMMARY OF THE INVENTION

According to one aspect, the present invention provides a fixing device comprising a cylindrical film including a heat generating layer and configured to be supplied with electrical power so that the heat generating layer generates heat, a first temperature detecting member contacting the film, a second temperature detecting member contacting the film and provided at such a position that temperature change at the position, at which the second temperature detecting member is provided, is slower in responsiveness than at a position at which the first temperature detecting member is provided, and a controller configured to control the electrical power supplied to the film, wherein a toner image, formed on a recording material, is heated by heat from the film and is fixed on the recording material, and wherein the controller stops supply of the electrical power to the film depending on a difference value between a detection temperature of the first temperature detecting member and a detection temperature of the second temperature detecting member.

According to another aspect, the invention provides a fixing device comprising a cylindrical film including a heat generating layer and configured to be supplied with electrical power so that the heat generating layer generates heat, a first temperature detecting member contacting the film, a second temperature detecting member contacting the film and provided at such a position that temperature change at the position, at which the second temperature detecting member is provided, is slower in responsiveness than at a position at which the first temperature detecting member is provided, and a controller configured to control the electrical power supplied to the film, wherein a toner image, formed on a recording material, is heated by heat from the film and is fixed on the recording material, and wherein the controller stops supply of the electrical power to the film depending on a difference value between a change amount per unit time of a detection temperature of the first temperature detecting member and a change amount per unit time of a detection temperature of the second temperature detecting member.

Further features of the present invention will become apparent from the following description of exemplary embodiments with reference to the attached drawings.

DESCRIPTION OF EMBODIMENTS

Embodiments of the present invention will be described specifically with reference to the drawings.

First Embodiment

Fixing Device

In the following description, as regards a fixing device and constituent members of the fixing device, a longitudinal direction is a direction perpendicular to a recording material feeding direction in a plane of a recording material. A short-side (widthwise) direction is a direction parallel to the recording material feeding direction in the plane of the recording material. A longitudinal width refers to a dimension with respect to the longitudinal direction, and a short-side width refers to a dimension with respect to the short-side (widthwise) direction.

Figure 1:
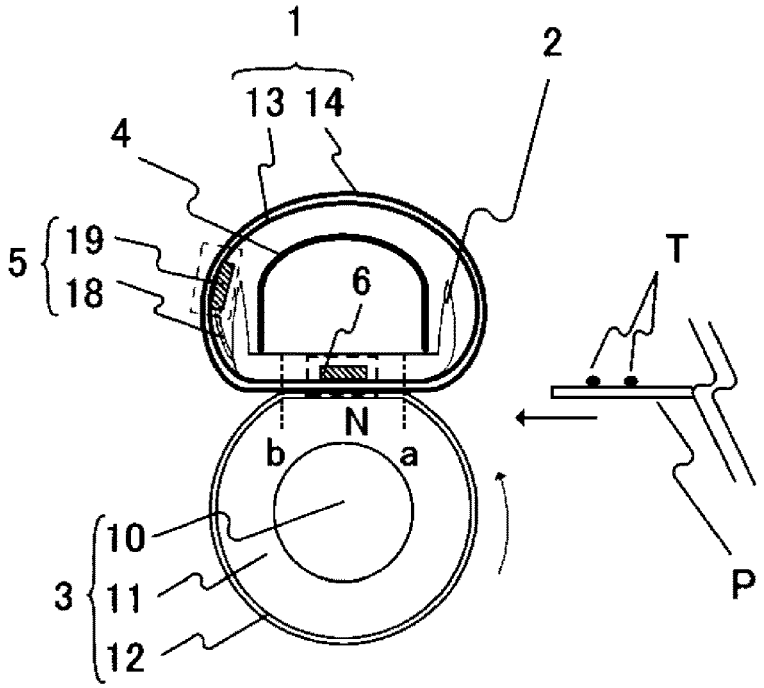
FIG. 1 is a schematic view showing a cross section perpendicular to a longitudinal direction of a film of a fixing device according to First Embodiment.
Figure 2:
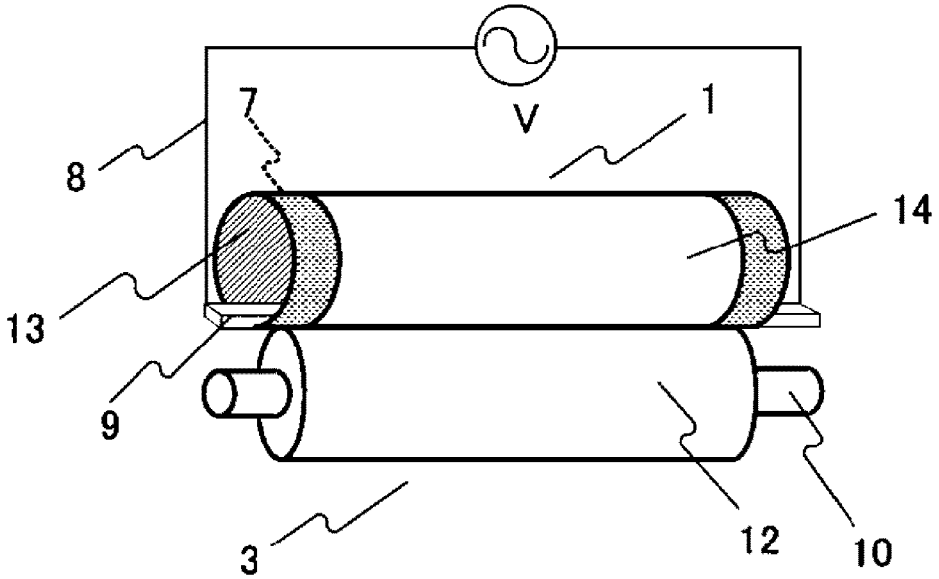
FIG. 2 is a schematic view showing a structure of the fixing device according to First Embodiment with respect to the longitudinal direction of the film.

A structure of the fixing device according to this embodiment will be described with reference to FIGS. 1 to 5. FIG. 1 is a schematic view showing a cross section of the fixing device, perpendicular to a longitudinal direction of the fixing device, and FIG. 2 is a schematic view showing a structure of the fixing device with respect to the longitudinal direction.

The fixing device in this embodiment includes an endless (cylindrical) rotatable film 1 and a film guiding member 2 as a supporting member (guiding member) for supporting and guiding the film 1 from an inner surface of the film 1. The fixing device further includes a pressing roller 3 as an opposing member for forming a nip N in a cooperation with the film 1 and includes a reinforcing stay 4. Further, in the fixing device, a main thermistor 5, as a first temperature detecting member for detecting a temperature of the film 1, and a sub-thermistor 6, as a second temperature detecting member for detecting the temperature of the film 1, are provided so that temperature detecting positions thereof are different from each other with respect to a circumferential direction of the film 1. From a right side in FIG. 1, a recording material (recording paper sheet) P, carrying thereon a toner image T, is nipped and fed through the nip N while being heated, so that the toner image is fixed on the recording material P. That is, the toner image T, formed on the recording material P, is heated by heat from the film 1 and is fixed on the recording material P.

The film 1 includes a heat generating layer 13 as a base layer, and has a three-layer structure including the base layer, an intermediary layer (not shown), and a coating layer 14. The heat generating layer 13 is a layer that generates heat by energization (supply of electrical power), and that is also a layer having mechanical characteristics, such as torsion strength, smoothness, and the like. The heat generating layer 13 is formed by dispersing an electroconductive filler, such as carbon black, in a resin material, such as polyimide. An electrical resistance of the heat generating layer 13 is adjusted so that the heat generating layer 13 generates heat under application of an alternating current (AC) voltage from an AC voltage source (power source). The intermediary layer (not shown) has a function of an adhesive for bonding the coating layer 14 and the heat generating layer 13 to each other.

The heat generating layer 13 is formed of a polyimide resin material in a layer of fifty μm in thickness, eighteen mm in outer diameter, and two hundred and forty mm in length with respect to the longitudinal direction. In the polyimide resin material of the heat generating layer 13, carbon black is dispersed as the electroconductive filler. In this embodiment, the coating layer 14 is used as a parting layer, and, therefore, the coating layer 14 is a fifteen μm-thick layer of tetrafluoroethylene-perfluoroalkylvinyl ether copolymer (PFA).

The film guiding member 2 is formed of a heat-resistant resin material, such as a liquid crystal polymer, polyphenylene sulfide (PPS), or polyether ether ketone (PEEK). The film guiding member 2 is engaged at longitudinal end portions thereof with the reinforcing stay 4 held by a fixing device frame. Further, the reinforcing stay 4 is urged at longitudinal end portions thereof by urging means (not shown) so that the film guiding member 2 is pressed against the film 1 toward the pressing roller 3.

The reinforcing stay 4 is formed of a rigid material, such as iron, stainless steel or a zinc-coated steel plate, so that urging forces received at the longitudinal end portions can be uniformly transmitted to the film guiding member 2 with respect to the longitudinal direction. The reinforcing stay 4 is enhanced in flexural rigidity by being formed in a cross-sectional shape (U-shape), such that a geometrical moment of inertia is large. Thus, by suppressing a degree of flexure of the film guiding member 2, a width (distance between a and b in FIG. 1) of the nip N with respect to a rotational direction of the film 1 is substantially uniform with respect to the longitudinal direction.

In this embodiment, the liquid crystal polymer is used as the material of the film guiding member 2, and the zinc-coated steel plate is used as the material of the reinforcing stay 4. A pressing force (pressure) applied to the pressing roller 3 is one hundred sixty N, and, at this time, the width (a-b distance) of the nip N with respect to the rotational direction of the film 1 is six mm.

The pressing roller 3 is constituted by a metal core 10 formed of a material, such as iron or aluminum, an elastic layer 11 formed of a material of a silicone rubber, and a parting layer 12 formed of a material of PFA. Hardness of the pressing roller 3 may preferably be forty degrees to seventy degrees as measured under a load of one kgf by an ASKER-C hardness meter, so that the hardness can satisfy durability and a width of the nip N satisfying a fixing property. In this embodiment, the pressing roller 3 function as not only a pressing member for forming the nip N, but also a heat absorbing member described later.

In this embodiment, the metal core 10 formed of iron and having a diameter of eleven mm, the silicone rubber layer of 3.5 mm in thickness is formed as the elastic layer 11, and on the elastic layer 11, an insulating PFA tube of forty μm in thickness is formed as the parting layer 12. The pressing roller 3 is fifty-six degrees in hardness and eighteen mm in outer diameter. Each of the elastic layer 11 and the parting layer 12 is two hundred and twenty-six mm in length with respect to the longitudinal direction.

As shown in FIG. 2, with an energizing member 9, an AC cable 8 connected to an AC voltage source (power source) V is connected, and energization to the heat generating layer 13 is carried out by applying an AC voltage from the AC voltage source to the energizing member 9. The energizing member 9, formed with a stainless steel plate, is disposed at each of end portions inside the nip N with respect to the longitudinal direction of the film 1, and contacts an inner surface of the heat generating layer 13. The energizing member 9 is pressed against the film 1 toward the rubber layer of the pressing roller 3. The energizing member 9 is five mm in width with respect to the rotational direction of the film 1 and enters an inside of the nip N by five mm from each of longitudinal ends of the nip N with respect to the longitudinal direction of the film 1.

Figure 3:
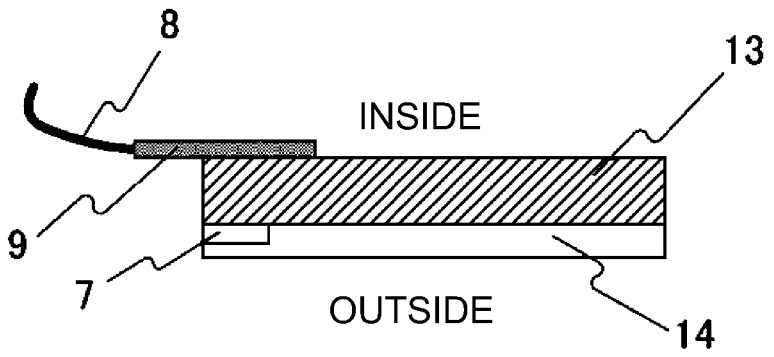
FIG. 3 is a longitudinal sectional view of a film 1 at a longitudinal end portion of a nip N.

FIG. 3 is a longitudinal sectional view of the film 1 at one longitudinal end portion of the nip N. At each of longitudinal end portions each having a width (length) of twelve mm from an associated longitudinal end of the film 1 on the surface, of the heat generating layer 13 in a side opposite to a side where the energizing member 9 contacts the heat generating layer 13, an electroconductive layer 7 (FIGS. 2 and 3), formed by coating with silver paste over an entire region with respect to the rotational direction of the film 1, is provided. A surface resistance value of the electroconductive layer 7 is less than the heat generating layer 13.

An actual resistance value between the energizing members 9 (two hundred forty mm) with respect to the longitudinal direction of the film 1 is twenty Ω, and an actual resistance value between the energizing member 9 and the electroconductive layer 7 with respect to the thickness direction of the film 1 is 1.8Ω. Incidentally, in a case in which the electroconductive layer 7 is not formed, an actual resistance value between the energizing members 9 with respect to the longitudinal direction of the film 1 is forty-two Ω, and, therefore, it is understood that a current easily flows from the energizing member 9 in the film rotational direction of the heat generating layer 13 through the electroconductive layer 7. The electroconductive layer 7 may also include an electroconductive intermediary layer (not shown) for facilitating bonding between the electroconductive layer 7 and the heat generating layer 13.

The above-described settings are those made on the assumption that the voltage of the AC voltage source is one hundred V.

First and Second Temperature Detecting Members

In this embodiment, the fixing device includes the main thermistor 5 as the first temperature detecting member for detecting the temperature of the film 1, and the sub-thermistor 6 as the second temperature detecting member, different in temperature change responsiveness from the main thermistor 5, for detecting the temperature of the film 1.

In this embodiment, a heat absorbing member is provided in an opposite side from, or in an identical side to, the sub-thermistor 6 with respect to the film 1, but is not provided in an opposite side from or in an identical side to the main thermistor 5 with respect to the film 1. Thus, in this embodiment, depending on the presence or the absence of the heat absorbing member, apparent thermal capacity values of the main thermistor 5 and the sub-thermistor 6 that contact the film 1 are different from each other, so that a temperature change responsiveness of the film is different between the main thermistor 5 and the sub-thermistor 6. Incidentally, the main thermistor 5 and the sub-thermistor 6 that do not contact the film 1 are temperature detecting members having the same thermal capacity.

Figure 4:
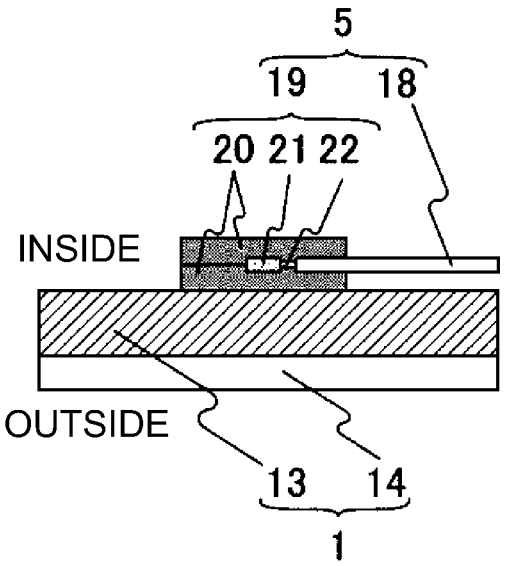
FIG. 4 is a detailed view of a left-side broken line region (main thermistor 5) in FIG. 1.

Specifically, in the following description, the main thermistor 5 will be described using FIG. 4, and the sub-thermistor 6 will be described using FIG. 5. FIG. 4 is a detailed view of a region in which the main thermistor 5 contacts the film 1, enclosed by a broken line in a left-hand side in FIG. 1.

As shown in FIGS. 4 and 1, the main thermistor 5 is constituted by a stainless steel arm 18, fixed and supported by the film guiding member 2, and a thermistor element 19. Further, as shown in FIG. 4, the thermistor element 19 is constituted by a heat sensitive element 21, Dumet wire 22, and an insulating material (member) 20. The arm 18 urges the thermistor element 19 against an inner surface of the film 1, and, even in a case in which a locus of the inner surface of the film 1 is displaced, the thermistor element 19 is maintained in a state in which the thermistor element 19 always contacts the inner surface of the film 1.

The arm 18 also functions as a signal line. One end portion of the arm 18 is connected with the heat sensitive element 21 via the Dumet wire 22, and the other end portion of the arm 18 is connected with a central processing unit (CPU) 30 (controller), shown in FIG. 6, through wiring.

The insulating material 20 is a polyimide tape, and protects the heat sensitive element 21 so that the heat sensitive element 21 does not electrically contact the film 1. The main thermistor 5 is disposed with a distance from the members other than the film 1, and is configured so as not to contact the members other than the film 1. In a side opposite to the main thermistor 5 with respect to the film 1, no member is provided. In this embodiment, the main thermistor 5 is disposed downstream of the nip N with respect to the rotational direction of the film 1, but an arrangement position of the main thermistor 5 is not limited to the downstream position.

Figure 5:
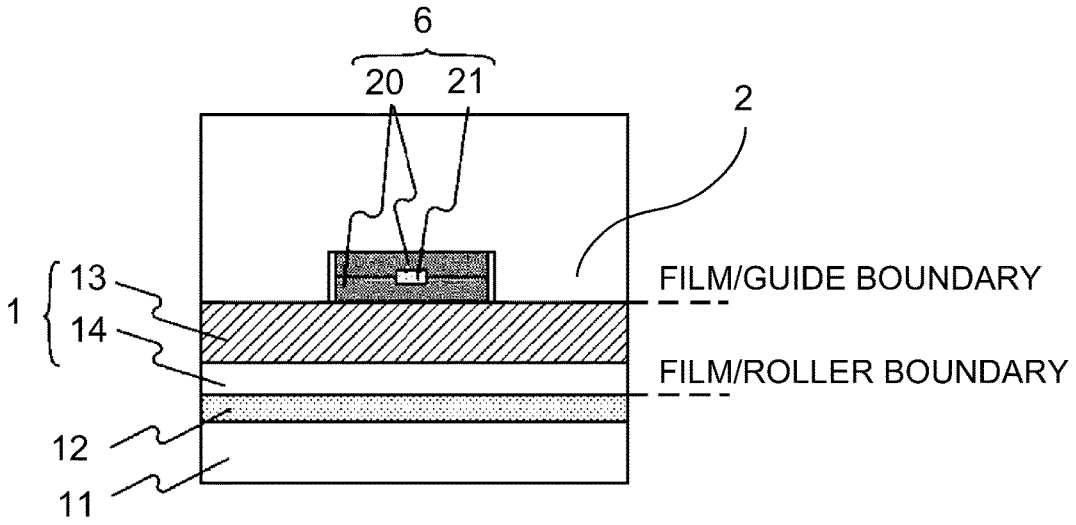
FIG. 5 is a detailed view of a central-side broken line region (sub-thermistor 6) in FIG. 1.

FIG. 5 is a detailed view of a region, in which the sub-thermistor 6 contacts the film 1, enclosed by a broken line at a central portion in FIG. 1. As shown in FIG. 5, a thermistor element of the sub-thermistor 6 is constituted by a heat sensitive element 21, an insulating material 20, and an unshown Dumet wire, and the heat sensitive element 21 is connected with the CPU 30 (FIG. 6) through the Dumet wire. The thermistor element of the sub-thermistor 6 is held by the film guiding member 2 and contacts an inner peripheral surface of the film 1. In a side opposite to the sub-thermistor 6 with respect to the film 1, the pressing roller 3, as the heat absorbing member corresponding to the sub-thermistor 6, exists.

Thus, the main thermistor 5 is disposed with a distance from the members other than the film 1, whereas, in the side opposite to the sub-thermistor 6 with respect to the film 1, the pressing roller 3, as the heat absorbing member, is disposed. For this reason, the main thermistor 5 and the sub-thermistor 6 are different in apparent thermal capacity including that of a peripheral member from each other. That is, the main thermistor 5 and the sub-thermistor 6 are provided at such positions that a temperature change at the position at which the sub-thermistor 6 is provided is slower in responsiveness than at the position at which the main thermistor 5 is provided.

Here, as shown in FIGS. 4 and 5, as the heat sensitive elements 21 in the thermistor elements of the main thermistor 5 and the sub-thermistor 6, the same temperature detecting element is used. Further, the main thermistor 5 and the sub-thermistor 6 exist in a region in which the recording material P passes with respect to the longitudinal direction of the film 1.

Block Diagram and Flowchart

Figure 6:
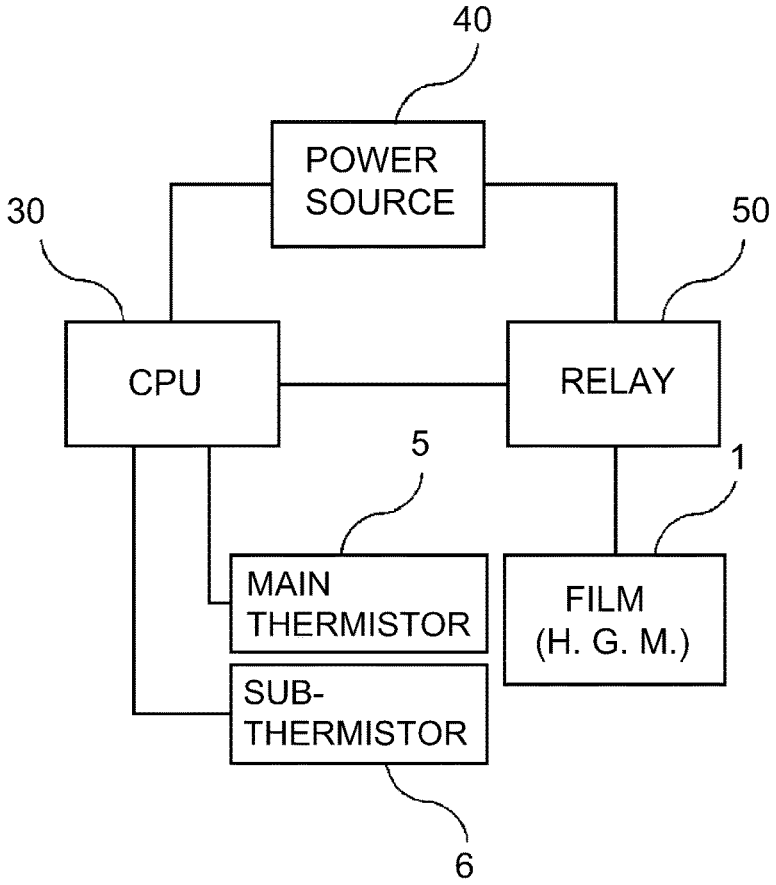
FIG. 6 is a block diagram showing a constitution of a fixing control system in First Embodiment.

FIG. 6 is a block diagram showing a constitution of a fixing control system in this embodiment. The heat sensitive elements 21 of the main thermistor 5 and the sub-thermistor 6 are connected with the CPU 30. The CPU 30 not only effects temperature control by controlling energization to the film 1 on the basis of an output value of the thermistor element 19 of the main thermistor 5, but also blocks the energization to the film 1 by blocking a relay switch when a predetermined condition is satisfied.

Figure 7:
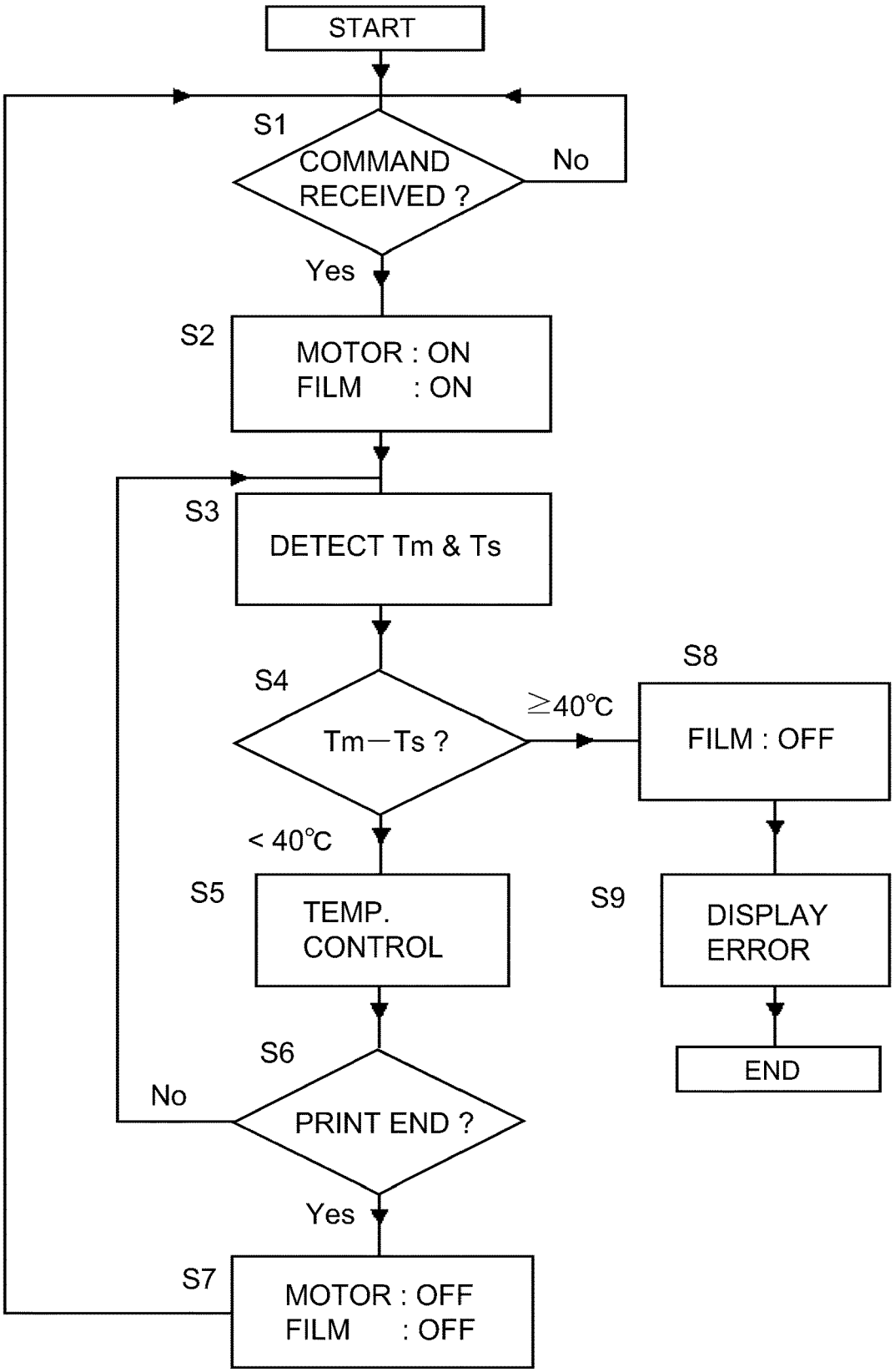
FIG. 7 is a flowchart showing an algorithm of fixing control in First Embodiment.

FIG. 7 is a flowchart for illustrating a control method of the fixing device in this embodiment. In step S1, when a print command is received, energization to a driving motor of the fixing device and the film 1 are turned on simultaneously in step S2, so that a temperature rise of the film 1 starts. Thereafter, in step S3, a temperature Tm of the main thermistor 5 and a temperature Ts of the sub-thermistor 6 are detected, and, in step S4, a value of Tm−Ts is acquired. In a case in which this difference value (Tm−Ts) is less than forty ° C., the sequence goes to step S5, in which printing under normal temperature control is carried out.

Until the printing ends, steps from step S3 to step S5 are repeated, and, when the printing ends, the sequence goes to step S7, in which the energization (energization state) to the driving motor and the film 1 is stopped, and the driving motor and the film 1 are returned to a stand-by state again.

In step S4, when the value of Tm−Ts is forty ° C. or more, it is assumed that the temperature rise of the film 1 occurs in a state in which the rotation of the film 1 stops due to a device abnormality, such as a slip of the film 1. Then, the sequence immediately goes to step S8, in which the energization (electrical power supply) to the film 1 stops, and, in step S9, an error is displayed and the sequence ends. That is, in this embodiment, the CPU 30 stops the electrical power supply to the film 1 depending on the difference value (Tm−Ts) between the detection temperature Tm of the main thermistor 5 and the detection temperature Ts of the sub-thermistor 6. In this embodiment, the difference between the detection temperatures of the thermistors was monitored, but a difference between output voltages of the thermistors may also be used as the difference in step S4.

Figure 8:
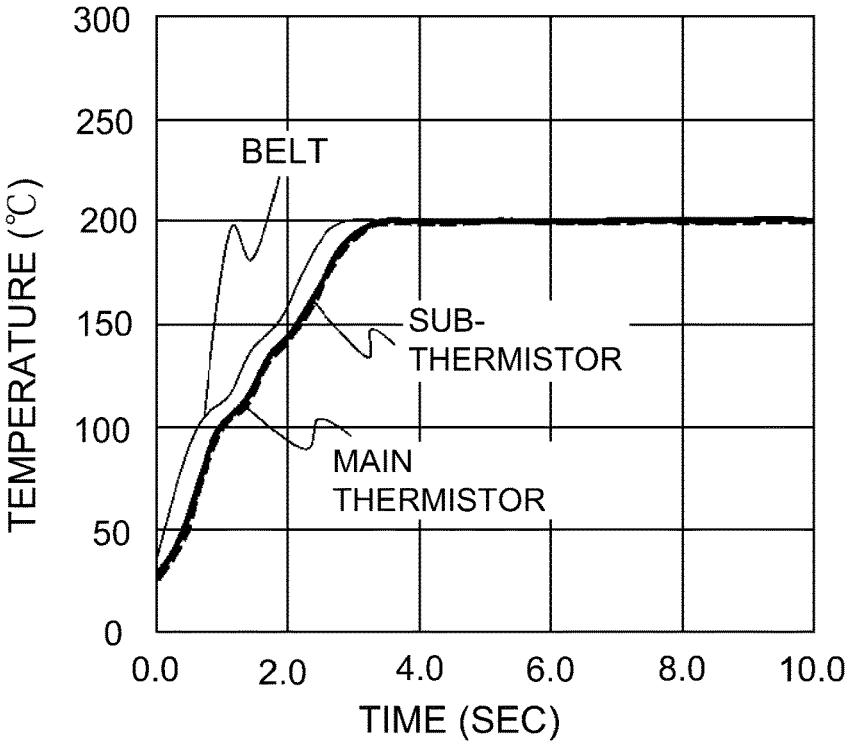
FIG. 8 is a graph showing detection temperatures of the main thermistor and the sub-thermistor and an actual temperature behavior of the film 1 when energization to the film 1 is started in a state in which a motor rotates.

Output Change of First and Second Temperature Detecting Members During Normal Operation Due to Rotation of Film and Energization to Film FIG. 8 is a graph in which a change in detection temperature of each of the temperature detecting members is recorded in a state in which the film 1 normally rotates in the fixing device in this embodiment. In FIG. 8, a thermopile measures a temperature on the outer peripheral surface of the film 1 (i.e., an actual belt temperature). The thermopile has a high responsiveness (thermal time constant: twenty msec), and, therefore, the thermopile measures the surface temperature of the film 1 relatively accurately.

Immediately after the temperature rise of the film 1 starts, although there is a difference (divergence) between the temperature of the film 1 and the detection temperatures of the main thermistor 5 and the sub-thermistor 6, the difference is small in a state in which the film temperature is stabilized by subsequent temperature control. Further, the detection temperatures of the main thermistor 5 and the sub-thermistor 6 always indicate substantially the same value. In this case, in accordance with the control flow of the fixing device described using FIG. 7, normal temperature control (electrical power control) is carried out until the printing ends.

Figure 9:
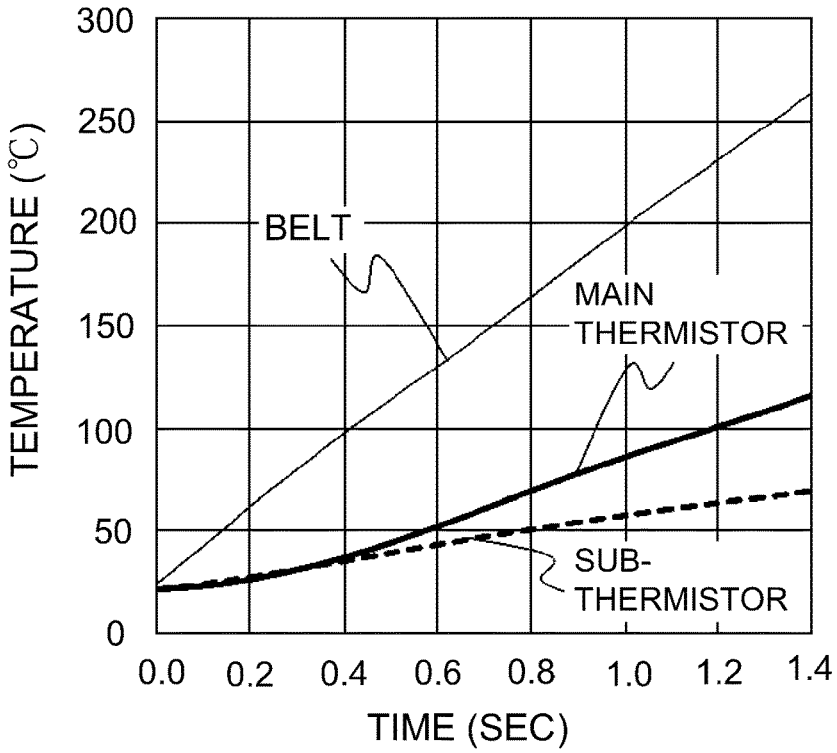
FIG. 9 is a graph showing detection temperatures of the main thermistor and the sub-thermistor and an actual value behavior of the film 1 when energization to the film 1 is started in a state in which the motor is at rest (stops).

Output Change of First and Second Temperature Detecting Members During Temperature Rise Abnormal Due to Stop of Rotation of Film and Energization to Film FIG. 9 is a graph in which a change in detection temperature of each of the temperature detecting members when the energization to the film 1 is started in a state in which the rotation of the motor is stopped in the fixing device in this embodiment is recorded. The detection temperatures of the respective temperature detecting members at the time a lapse of 1.4 sec from the start of the energization to the film 1 were two hundred sixty-five ° C. for the thermopile ("BELT" (actual belt temperature)), one hundred fifteen ° C. for the main thermistor 5, and seventy ° C. for the sub-thermistor 6. In a state in which the motor is at rest, the temperature of the film 1 abruptly increases. This is because the film 1 is not rotated and, therefore, there is no opportunity to conduct heat to the pressing roller 3.

Compared with the film temperature rise, the rise of the detection temperature of the main thermistor 5 is largely delayed. This is because at only a portion of the film 1 contacting the main thermistor 5, heat is taken by the main thermistor 5, and, therefore, the thermistor rise at that portion is delayed as compared with a film portion that is in non-contact with other members. Further, the film 1, which is the heat generating member, is small in thermal capacity and is large in temperature change when the heat is taken by contact with the member, and this large temperature change is also the cause of the large difference in detection temperature.

The temperature rise of the detection temperature of the sub-thermistor 6 is further delayed compared with that of the main thermistor 5. This is because the heat of the film 1 at the contact portion with the sub-thermistor 6 is taken by the pressing roller 3 contacting the film 1. Further, the film guiding member 2 contacting the sub-thermistor 6 takes the heat from the sub-thermistor 6, and this also constitutes a factor of the delay of the temperature rise of the detection temperature of the sub-thermistor 6.

When the motor was driven, there arose no large difference in detection temperature between the main thermistor 5 and the sub-thermistor 6. This is because, during the rotation of the film 1, the heat generated in the film 1 with respect to a circumferential direction is successively carried to the thermistors, and, therefore, amounts of heat received per unit time by the main thermistor 5 and the sub-thermistor 6 are sufficiently large. Further, during the rotation of the film 1, the pressing roller 3 uniformly takes the heat from the film 1 over the circumferential direction, and, therefore, the temperature difference does not readily generate between the nip N and another portion of the film 1.

Thus, in the fixing device in this embodiment, it is possible to detect that the film 1 is in a rotation state or a rest (stop) state by using a difference in temperature rise characteristic of the thermistors between the rotation state and the rest state of the film 1.

From the above arrangement, in this embodiment, in a case in which the energization to the film 1 is carried out in a state in which the film 1 is not driven due to the device abnormality, such as the slip of the film 1, the energization is quickly stopped by the CPU 30 as an abnormal detection means. As a result, it becomes possible to suppress thermal damage to the film 1.

Comparison with Comparison Example

Figure 16:
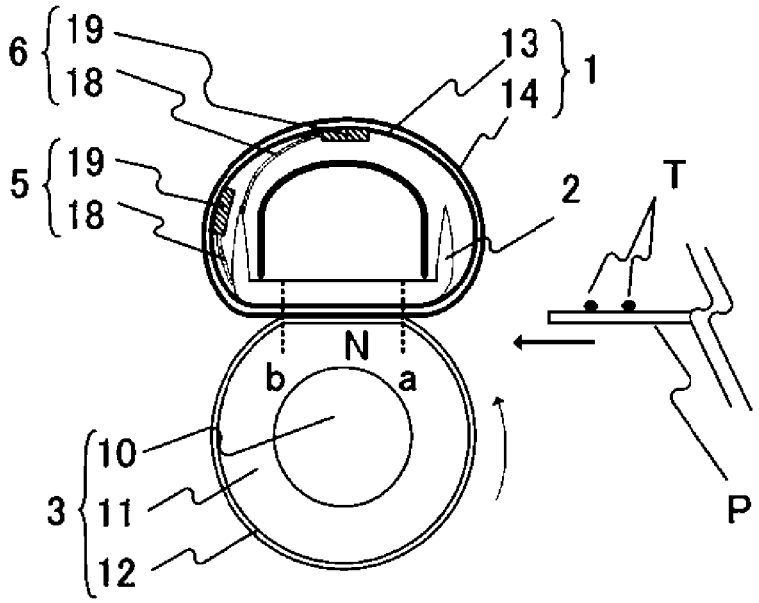
FIG. 16 is a schematic view showing a cross section, perpendicular to a longitudinal direction of a film, of a fixing device in a comparison example.

FIG. 16 is a schematic view showing a structure of a comparison example. A sub-thermistor 6 exists in a position other than a nip N and is mounted on an end of an arm 18, and is disposed with a distance from members other than a film 1. This arrangement of the sub-thermistor 6 is similar to that of a main thermistor 5. In this case, the main thermistor 5 and the sub-thermistor 6 are the same in thermal capacity and are the same in responsiveness. For that reason, irrespective of rotation and rotation stop of the film 1, the main thermistor 5 and the sub-thermistor 6 indicate substantially the same detection temperature value, and, therefore, based on the difference in detection temperature, the rotation state and the rotation stop state of the film 1 cannot be detected.

In order to change the temperature change responsiveness of the main thermistor 5 and the sub-thermistor 6, it is effective that the heat absorbing member providing thermal capacity is contacted to one of the thermistors, or, as in Embodiment 1 of the present invention, the heat absorbing member is contacted to the film 1 in the side opposite to one of the thermistors with respect to the film 1. Thus, in a case in which the temperature change responsiveness is changed, the rotation state and the rotation stop state of the film 1 are detected by the above-described method, so that the thermal damage to the film 1 can be prevented.

Comparison Based on Outputs of First and Second Temperature Detecting Members

Further, in this embodiment (Embodiment 1), when the value of the difference (Tm−Ts), which is an example of a comparison result based on the temperature Tm of the main thermistor 5 and the temperature Ts of the sub-thermistor 6, is forty ° C. or more, the energization to the film 1, which is the heat generating member, is stopped, but a threshold of the difference may also be not forty ° C. or more. In the following description, a setting method of the threshold of the difference (Tm−Ts) will be described.

Even in a state in which the film 1 normally rotates, there arises some difference in detection temperature between the main thermistor 5 and the sub-thermistor 6 during the start of the rotation, or the like. For that reason, when the threshold is excessively small, even in a case in which the fixing device normally operates, the temperature rise of the film 1 stops in some instances. In the constitution in this embodiment, the threshold may preferably be set at about twenty ° C. or more.

When the threshold is excessively large, in a case in which the energization to the film 1, which is the heat generating member, is started during the device abnormality, such that the film 1 does not normally rotate, a time in which Tm−Ts reaches the threshold is delayed, so that the stop of the energization to the film 1 is delayed. For that reason, the temperature of the film 1 becomes high, so that the thermal damage to the film 1 generates in some cases. In the constitution in this embodiment, the threshold may preferably be set at fifty ° C. or less.

From the above arrangement, the threshold of Tm−Ts is required to be set at a value at which Tm−Ts does not arrive during normal drive (rotation) of the film 1, and which is a proper value such that, during the device abnormality, such as the slip of the film 1, the energization to the film 1 is stopped before the temperature of the film 1 reaches a temperature at which the film 1 is thermally damaged. In the constitution in this embodiment, it is proper that the threshold is set between twenty ° C. and fifty ° C., and in this embodiment, the threshold was set at forty ° C.

In the following, a blocking (turning-off) condition of the relay switch in the fixing device in this embodiment will be described. There are two blocking conditions of the relay switch in this embodiment, and either of the two blocking conditions is set for preventing generation of the thermal damage to the film 1 caused by placing the film 1 in a high temperature state.

One blocking condition is such that the detection temperature difference between the main thermistor 5 and the sub-thermistor 6 is forty ° C. or more and is a state in which the temperature rise of the film 1 is generated by the energization to the film 1 when the film 1 is not rotated. The other blocking condition is such that either of detection temperatures of the main thermistor 5 and the sub-thermistor 6 exceeds two hundred fifty ° C. This blocking condition is a state in which the temperature of the film 1 is high due to some abnormality during the rotation of the film 1.

Second Embodiment

A structure of a fixing device according to Second Embodiment of the present invention will be described. In this embodiment, as a comparison based on the outputs of the first and second temperature detecting members, a comparison different from the comparison in First Embodiment is used. A constitution common to First and Second Embodiments will be omitted from description.

Figure 10:
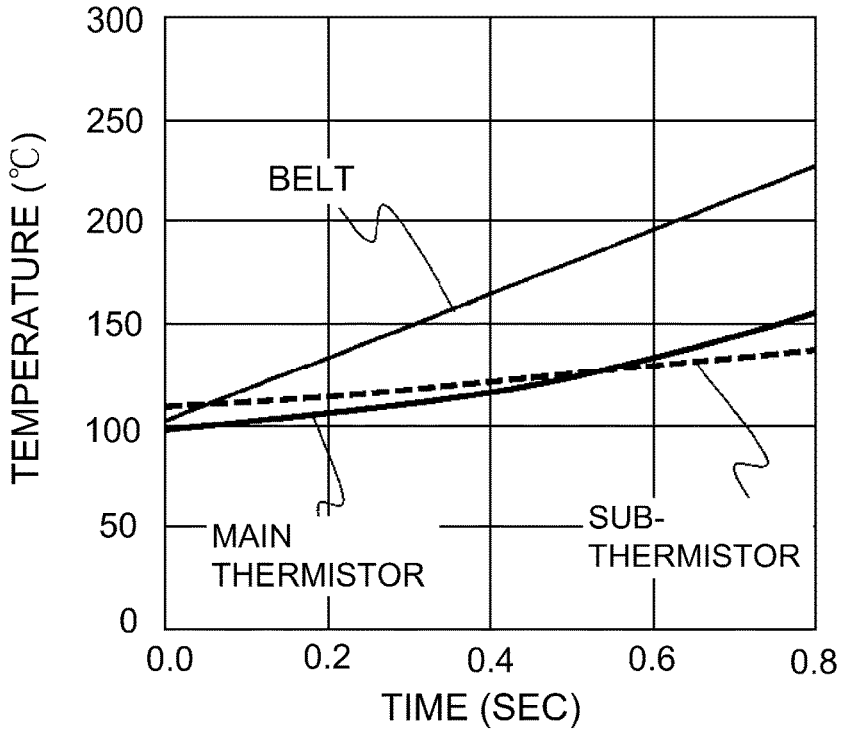
FIG. 10 is a graph showing detection temperatures of the main thermistor and the sub-thermistor and an actual temperature behavior of the film 1 when energization to the film 1 is started in a state in which the motor is at rest after continuous sheet passing through a fixing device according to Second Embodiment.

FIG. 10 is a graph in which changes in detection temperature of the respective temperature detecting members, when the energization to the film 1 is carried out in a state in which the motor is stopped after the fixing device is warmed by continuous sheet passing (fixing operation of the toner images on several tens of sheets of the recording material (recording paper)), are recorded. At the time of a start of the energization, the detection temperature of the main thermistor 5 is less than the detection temperature of the sub-thermistor 6. This is a difference generated in a process in which the fixing device is cooled after being warmed by the continuous sheet passing, or the like, and the thermal capacity of the film 1 to which the main thermistor 5 is contacted is small, so that the temperature of the film 1 is liable to decrease. On the other hand, the thermal capacity of the pressing roller 3 in the side opposite to the sub-thermistor 6 with respect to the film 1 is large, and, therefore, the temperature of the film 1 does not readily decrease. Thus, the detection temperature difference generates between the main thermistor 5 and the sub-thermistor 6.

In this case, in the detecting method in First Embodiment, the arrival of the difference (Tm−Ts) at the threshold, as the comparison result based on the temperature Tm of the main thermistor 5 and the temperature Ts of the sub-thermistor 6, is delayed, so that the blocking (turning-off) of the energization to the film 1 is delayed. Therefore, in this embodiment, a difference (ΔTm−ΔTs) is used as the comparison result based on the temperature Tm of the main thermistor 5 and the temperature Ts of the sub-thermistor 6. That is, the energization to the film 1 is stopped when the difference (ΔTm−ΔTs) between a change amount per unit time (ΔTm) of the detection temperature of the main thermistor 5 and a change amount per unit time (ΔTs) of the detection temperature of the sub-thermistor 6 exceeds a threshold. In other words, the electrical power supply to the film 1 is stopped depending on the difference value (ΔTm−ΔTs) between the change amount per unit time (ΔTm) of the detection temperature of the main thermistor 5 and the change amount per unit time (ΔTd) of the detection temperature of the sub-thermistor 6.

From FIG. 10, which shows the changes of the detection temperatures of the first and second temperature detecting members when the energization to the film 1 is carried out in the state in which the motor is at rest, it is understood that ΔTm is larger than ΔTs. For example, at the time of a lapse of 0.8 sec from the start of the energization, ΔTm is about one hundred twenty-five ° C./sec, and ΔTs is about forty-two ° C./sec. On the other hand, when the energization to the film 1 is carried out in the state in which the motor is rotated, the difference (ΔTm−ΔTs) is relatively small (not shown).

In the following, a setting method of the threshold of ΔTm−ΔTs will be described. Even in the state in which the film 1 normally rotates, some difference generates between ΔTm and ΔTs, and, therefore, when the threshold is excessively small, even in a case in which the fixing device normally operates, the temperature rise of the film 1 stops in some instances. In the constitution in this embodiment, the threshold of ΔTm−ΔTs may desirably be set at about twenty-five ° C./sec or more.

When the threshold is excessively large, in a case in which the energization to the film 1, which is the heat generating member, is started during the device abnormality, such that the film 1 does not normally rotate, a time in which the difference (ΔTm−ΔTs) does not reach the threshold is delayed, so that there is a possibility the temperature of the film 1 becomes high, and the film 1 is thermally damaged. In the constitution in this embodiment, the threshold of ΔTm−ΔTs may desirably be set at about thirty-five ° C./sec or less. From the above arrangement, in the constitution in this embodiment, it is proper that the threshold of ΔTm−ΔTs is set between twenty-five ° C./sec and thirty-five ° C./sec, and in this embodiment, the threshold was set at thirty ° C./sec.

From the above arrangement, in this embodiment, it becomes possible to detect a rest state (non-rotation state) and a rotation state of the film 1 by detecting the difference (ΔTm−ΔTs) in change amount per unit time of the detection temperature. Then, in a case in which the energization to the film 1 is carried out in the state in which the film 1 is not driven (rotated), the energization to the film 1 is quickly blocked, so that the thermal damage to the film 1 can be suppressed.

Figure 11:
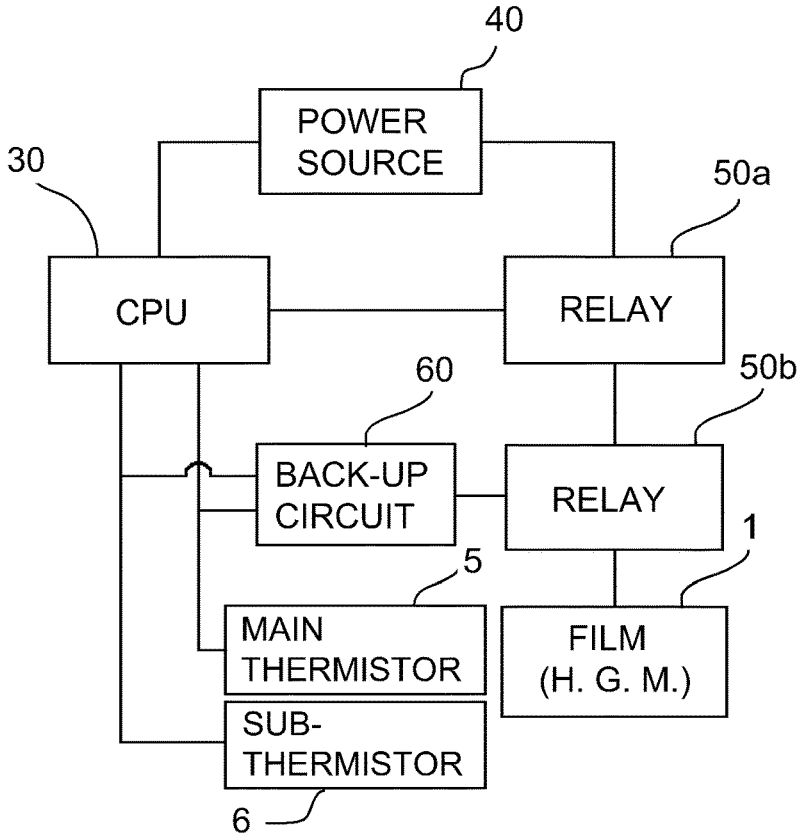
FIG. 11 is a block diagram showing a structure of a fixing control system in Second Embodiment.

Further, as shown in FIG. 11, this embodiment is also different in constitution of the fixing control system from First Embodiment. In this embodiment, a back-up circuit 60 is provided. The back-up circuit 60 is a circuit in which the change amounts per unit time of the detection temperatures of the main thermistor 5 and the sub-thermistor 6 are calculated and then the threshold of the difference (ΔTm−ΔTs) is discriminated, and exists independently of the CPU 30. Each of the CPU 30 and the back-up circuit 60 calculates the change amounts per unit time of the detection temperatures of the main thermistor 5 and the sub-thermistor 6, and turns off an associated relay switch (relay) 50*a* or 50*b* connected thereto when the difference exceeds the threshold.

As a result, when either one of the relay switches is turned off, the energization to the film 1 is blocked, and, therefore, even in in a case in which an abnormality generates in the CPU 30, the thermal damage to the film 1 can be suppressed by an operation of the back-up circuit 60.

Third Embodiment

Figure 12:
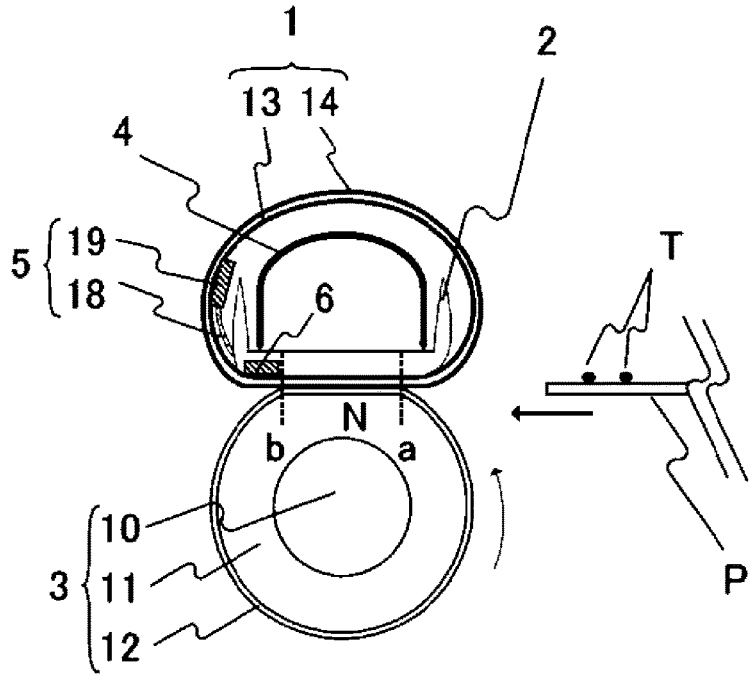
FIGS. 12 to 15 are schematic views showing cross sections, perpendicular to longitudinal directions of films, of fixing devices according to Third to Sixth Embodiments, respectively.

This embodiment is different from First and Second Embodiment (FIG. 1) in position of the sub-thermistor 6 and kind of the heat absorbing member. Other points are similar to those of First and Second Embodiments and will be omitted from description. In this embodiment, as shown in FIG. 12, the sub-thermistor 6 is disposed so as to be deviated from the nip N with respect to the recording material (paper) feeding direction. In this case, the film guiding member 2 is the heat absorbing member.

Also, in this embodiment, the heat of the sub-thermistor 6 and the heat of a portion of the film 1 to which the sub-thermistor 6 is contacted, are taken by the film guiding member 2, and, therefore, the difference in detection temperature between the main thermistor 5 and the sub-thermistor 6, or the difference in change amount per unit time of the detection temperature between the main thermistor 5 and the sub-thermistor 6 generates. In this embodiment, there are advantages that effects similar to those in First and Second Embodiments are achieved and that unevenness of the nip N by the sub-thermistor 6 is not generated.

Fourth Embodiment

Figure 13:
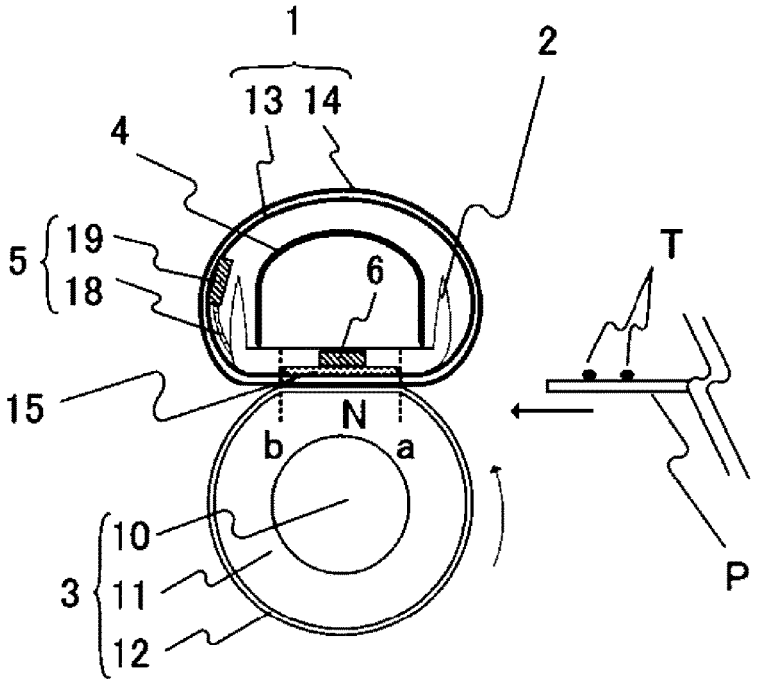

This embodiment is different from First and Second Embodiment (FIG. 1) in the position of the sub-thermistor 6 and the kind of the heat absorbing member. Other points are similar to those of First and Second Embodiments and will be omitted from description. In this embodiment, as shown in FIG. 13, between the sub-thermistor 6 and the film 1, a high-heat-conductive member 15 is provided as the heat absorbing member so as to contact both of the sub-thermistor 6 and the film 1. The position of the sub-thermistor 6 with respect to a direction (vertical direction in FIG. 13) perpendicular to the recording material feeding direction is different from the position of the sub-thermistor 6 with respect to the vertical direction in FIG. 1 by a thickness of the high-heat-conductive member 15, but the position of the sub-thermistor 6 with respect to the recording material feeding direction is similar to those in First and Second Embodiments (FIG. 1).

As the high-heat-conductive member 15, an aluminum plate subjected to surface treatment, a graphite sheet having a good thermal conductivity (larger than 0.0241 W/m·K which is the thermal conductivity of air), or the like, is used. The high-heat-conductive member 15 is sufficiently long in the longitudinal direction of the nip N and has an effect of uniformizing temperature non-uniformity with respect to the longitudinal direction of the fixing device. Further, the high-heat-conductive member 15 also functions as the heat absorbing member.

In the fixing device in this embodiment, when the energization to the film 1 is carried out in the state in which drive of the film 1 (belt) is at rest (stopped), the heat supplied from the film 1 to the sub-thermistor 6 is taken by the high-heat-conductive member 15 as the heat absorbing member. For this reason, the temperature rise of the sub-thermistor 6 is delayed compared with the temperature rise of the main thermistor 5, so that effects similar to those in First and Second Embodiments can be obtained.

Further, in this embodiment, a constitution in which the sub-thermistor 6 does not directly slide on the film 1 is employed, and, therefore, an effect of suppressing abrasion of the film 1 and the sub-thermistor 6 is achieved.

Fifth Embodiment

Figure 14:
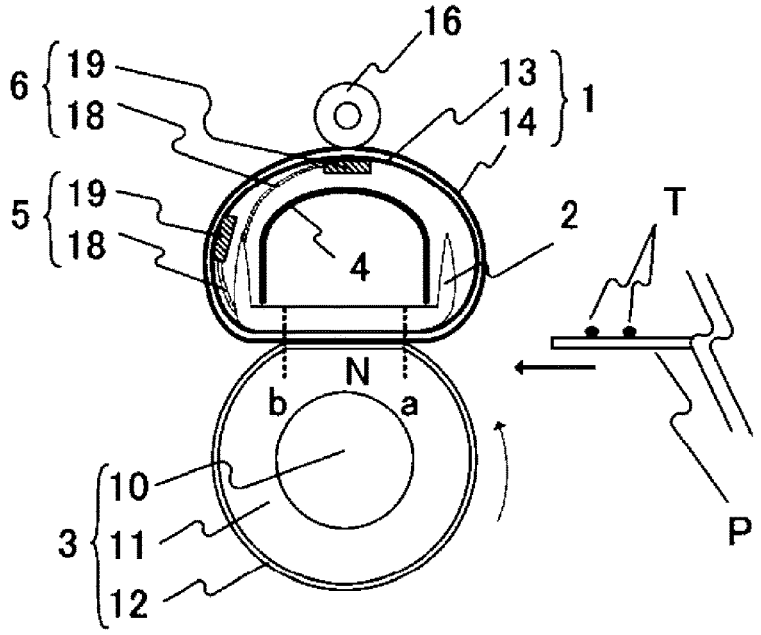

This embodiment is different from First and Second Embodiment (FIG. 1) in position of the sub-thermistor 6 and kind of the heat absorbing member. Other points are similar to those of First and Second Embodiments and will be omitted from description. In this embodiment, as shown in FIG. 14, the sub-thermistor 6 is disposed outside the nip N, and a roller member (cylindrical rotatable member) 16 is provided as the heat absorbing member in a side opposite to the sub-thermistor 6 with respect to the film 1. The sub-thermistor 6 has, similarly as in the case of the main thermistor 5, a structure such that the thermistor element 19 is mounted on the end of the arm 18, and contacts only the inner surface of the film 1. The roller member 16 is a rotatable member including a metal core at a center thereof and is rotated by rotation of the film 1.

Also, in this embodiment, when the energization to the film 1 is carried out in the state in which the rotation of the film 1 is at rest, the heat of a portion of the film 1 to which the sub-thermistor 6 is contacted is taken by the roller member 16 as the heat absorbing member, so that a difference generates in detection temperature between the main thermistor 5 and the sub-thermistor 6. Thus, also in this embodiment, effects similar to those in First and Second Embodiments can be obtained. Further, this embodiment has an advantage such that an arrangement position of the sub-thermistor 6 can be selected relatively freely.

Sixth Embodiment

Figure 15:
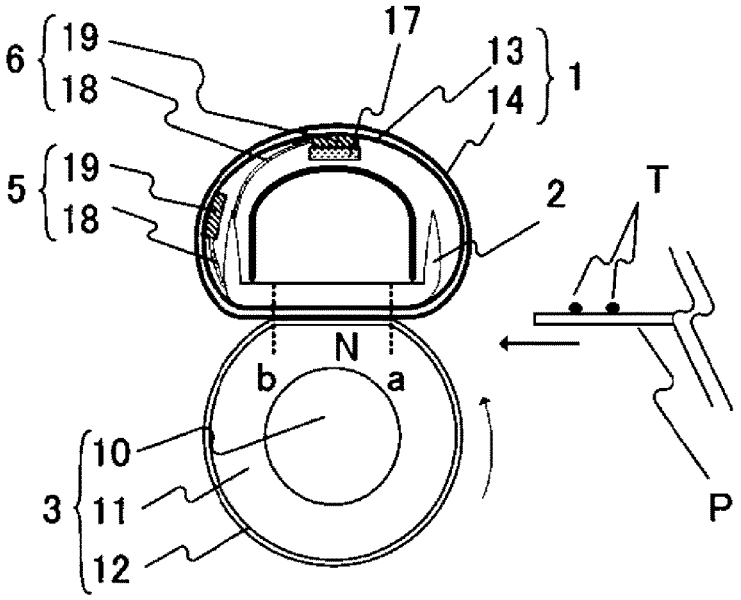

This embodiment is different from First and Second Embodiment (FIG. 1) in position of the sub-thermistor 6 and kind of the heat absorbing member. Other points are similar to those of First and Second Embodiments and will be omitted from description. In this embodiment, as shown in FIG. 15, in place of the roller member 16 described in Fifth Embodiment, a heat absorbing member 17, formed of a material, such as Kapton® tape, is provided in a contact state in a side opposite to the film 1 with respect to the sub-thermistor 6.

Thus, also in this embodiment, when the energization to the film 1 is carried out in the state in which the rotation of the film 1 is at rest, the heat of a portion of the film 1 to which the sub-thermistor 6 is contacted is taken by the heat absorbing member 17, so that a difference generates in detection temperature between the main thermistor 5 and the sub-thermistor 6. Thus, also in this embodiment, effects similar to those in First and Second Embodiments can be obtained.

MODIFIED EMBODIMENTS

In the above-described embodiments, the preferred embodiments of the present invention were described, but the present invention is not limited thereto and can be variously modified within the scope of the present invention.

Modified Embodiment 1

In the above-described embodiments, the energization to the film 1 was controlled on the basis of the output of the main thermistor 5, which is the first temperature detecting member, so that the temperature of the film 1 is a predetermined temperature, but the present invention is not limited thereto. The energization to the film 1 may also be controlled on the basis of at least one of the outputs of the first and second temperature detecting members, so that the temperature of the film is the predetermined thermistor.

Modified Embodiment 2

In the above-described embodiments, the heat absorbing means is provided in the side opposite to or identical to the sub-thermistor 6 with respect to the film 1, but is not provided in the side opposite to or identical to the main thermistor 5 with respect to the film. The present invention is not, however, limited thereto.

A constitution in which a first heat absorbing means is provided in the side opposite to or identical to the sub-thermistor 6 with respect to the film 1, and a second heat absorbing means is provided in the side opposite to or identical to the main thermistor 5 with respect to the film 1, and in which the first and second heat absorbing means are different in thermal capacity from each other, may also be employed.

Modified Embodiment 3

In the above-described embodiments, the main thermistor 5 and the sub-thermistor 6 were the temperature detecting members having the same thermal capacity in the state in which these thermistors are in non-contact with the film. In the state in which these thermistors are in contact with the film 1, these thermistors are different in apparent thermal capacity depending on the presence or the absence of the heat absorbing means, and thus, are different in temperature change responsiveness between these thermistors from each other. The present invention is not, however, limited thereto, but as regards the main thermistor 5 and the sub-thermistor 6, thermistors different in thermal capacity (different in temperature change responsiveness) due to different areas of heat sensitive portions in the state in which the main thermistor 5 and the sub-thermistor 6 are in non-contact with the film 1 can also be used.

In this case, without using the heat absorbing means, the main thermistor 5 and the sub-thermistor 6 are contacted to the film 1, and then can detect the temperature of the film 1 in a state in which the thermistors 5 and 6 are different in temperature change responsiveness.

Modified Embodiment 4

In the above-described embodiments, the recording paper was used as the recording material, but the recording material in the present invention is not limited to the paper. In general, the recording material is a sheet-like member on which the toner image is to be formed by the image forming apparatus, and includes, for example, regular or irregular plain paper, thick paper, thin paper, an envelope, a postcard, a seal, a resin sheet, an overhead projector (OHP) sheet, glossy paper, and the like. In the above-described embodiments, for convenience, as regards treatment of the recording material P, a description was made using terms such as the sheet (paper) passing and the sheet (paper) feeding direction, but by this description, the recording material in the present invention is not limited to the paper.

Modified Embodiment 5

In the above-described embodiments, the fixing device for fixing the unfixed toner image on the sheet was described as an example, but the present invention is not limited thereto. The present invention is similarly applicable to a device (apparatus) for heating and pressing a toner image temporarily fixed on the sheet in order to improve gloss (glossiness) of an image (also in this case, the device is referred to as the fixing device).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A fixing device comprising:

a cylindrical film including a heat generating layer, and configured to be supplied with electrical power so that said heat generating layer generates heat;

a first temperature detecting member contacting said film;

a second temperature detecting member contacting said film and being provided at such a position that a temperature change at a position, at which said second temperature detecting member is provided, is slower in responsiveness than at a position at which said first temperature detecting member is provided; and a controller configured to control the electrical power supplied to said film, wherein, when a difference between a detection temperature value output by said first temperature detecting member and a detection temperature value output by said second temperature detecting member is greater than a reference value, said controller assumes a temperature rise of said film occurs in a state in which the rotation of said film stops, and said controller stops supply of the electrical power to said film, wherein a toner image, formed on a recording material, is heated by heat from said film and is fixed on the recording material.

2. The fixing device according to claim 1, further comprising a guiding member contacting an inner surface of said film, wherein said second temperature detecting member has a film contacting surface at which said second temperature detecting member contacts the inner surface of said film, and wherein said guiding member contacts a surface of said second temperature detecting member that is opposite to the film contacting surface of said second temperature detecting member.

3. The fixing device according to claim 1, further comprising a rotatable member contacting said film in a region opposite to a region of said film in which said second temperature detecting member contacts said film, with respect to a thickness direction of said film, wherein, with respect to the thickness direction of said film, no member contacts a region opposite to the region of said film in which said first temperature detecting member contacts said film.

4. The fixing device according to claim 3, wherein, in a contact region between said film and said rotatable member, the recording material, on which the toner image is formed, is fed.

* * * * *